United States Patent [19]

Sato

[11] 4,035,114

[45] July 12, 1977

[54] METHOD FOR REDUCING POWER CONSUMPTION IN A LIQUID-COOLED ROTARY COMPRESSOR BY TREATING THE LIQUID

[75] Inventor: Goro Sato, Atami, Japan

[73] Assignee: Hokuetsu Kogyo Co., Ltd., Japan

[21] Appl. No.: 602,125

[22] Filed: Aug. 5, 1975

[30] Foreign Application Priority Data

Sept. 2, 1974 Japan ..... 49-99960

[51] Int. Cl.[2] ..... F01C 21/04; C04C 29/02

[52] U.S. Cl. ..... 418/84; 418/87; 418/88; 418/97

[58] Field of Search ..... 418/84, 85, 87, 88, 418/97–100; 415/116

[56] References Cited

U.S. PATENT DOCUMENTS

| | | | |
|---|---|---|---|
| 1,626,768 | 5/1927 | Vollmann | 418/98 |
| 2,070,151 | 2/1937 | Westin | 418/100 |
| 2,361,146 | 10/1944 | Montelius | 418/97 |
| 3,191,854 | 6/1965 | Lowler et al. | 418/97 |
| 3,260,444 | 7/1966 | Williams et al. | 418/85 |
| 3,542,497 | 11/1970 | Chapuis | 418/84 |
| 3,776,668 | 12/1973 | Abendschein | 418/97 |
| 3,820,923 | 6/1974 | Zweifel | 418/84 |

FOREIGN PATENT DOCUMENTS

| | | | |
|---|---|---|---|
| 1,009,347 | 5/1957 | Germany | 418/99 |
| 218,967 | 7/1942 | Switzerland | 418/87 |

*Primary Examiner*—John J. Vrablik
*Attorney, Agent, or Firm*—Bucknam and Archer

[57] ABSTRACT

A method for reducing power consumption in a liquid-cooled type rotary compressor wherein a mixture of gas compressed in at least one compression chamber and liquid for cooling, lubricating and sealing are separated from each other immediately after the mixture is delivered out of the compression chamber to a delivery chamber so that the gas and liquid are allowed to behave separately. Further comprising the step of regulating the amount of liquid injected into said compression chamber always when the compressor is in operation. The said delivery chamber has a structure and dimension suitable for separating liquid from gas.

3 Claims, 11 Drawing Figures

METHOD FOR REDUCING POWER CONSUMPTION IN A LIQUID-COOLED ROTARY COMPRESSOR BY TREATING THE LIQUID

BACKGROUND OF THE INVENTION

1. Field of the Invention

This invention relates to a method for reducing power consumption in a liquid-cooled type rotary compressor.

2. Description of the Prior Art

In all present day liquid-cooled type rotary compressors, the gas-liquid mixture delivered out of the compression chambers has been fed directly to a liquid separating tank, a compressed gas tank or a compressed gas and liquid tank without separating the liquid from the gas during ordinary compression operation. That is to say, little attention has been given to the difference in characteristics between gas and liquid and of the effects therebetween. The characteristics of gases and liquids, however, are totally different from each other even though both are fluids. Firstly, as gas is compressible and generates compressive heat when compressed, while a liquid is incompressible. Thus, if the compression chamber is completely filled with liquid, the rotary compressor may cause stopping or may be damaged because of liquid-lock trouble. The compressor is also forced to do excessive work resulting in extra power consumption. Secondly, the viscosity of a liquid is several thousand times that of a gas, so that flow resistance of liquids and gases are very much different from each other. Therefore, it is difficult to determine the structure and dimension of conduits or pipe lines in which the mixing ratio is not uniform, which results in low efficiency compressor design based on imaginary conditions. Thirdly, since the specific gravity of liquids is several times that of gases, a liquid and a gas can easily be separated from each other by gravitation and exhibit different behaviors, so that liquid-hammering phenomenon or gas-choke phenomenon often occurs in conduits.

Thus, even persons inexperienced in hydrodynamics will realize that it is extremely difficult to deal reasonably with both fluids under a mixed condition.

SUMMARY OF THE INVENTION

The present invention provides an improved method for reducing the power required in a liquid-cooled type rotary compressor by separating the liquid which is used for cooling the compressed gas and the compression chamber, and for lubricating and sealing the compression chamber from the gas immediately after the gas-liquid mixture is delivered out of the compression chamber into a delivery chamber so as to enable the gas and liquid to separately behave. Thus, in the present invention fluid passages have improved structures to reduce power consumption as well as to prevent damage to the machine. The present invention is different from prior art devices since the former is based on control of liquid while the latter is based on control of gas.

The effect of the present invention is particularly pronounced during loaded and half-loaded operation or volume controlled operation where the ratio of liquid to gas increases, although the present invention can also be used in an ordinary compression operation. For example, in a prior compressor provided with a suction-port closing type unloader, 60% of full load power is consumed during the unloaded operation, while in the present invention, the power consumption can be reduced to 18%. Thus, the liquid-cooled type rotary compressor according to the present invention is superior to the conventional reciprocating piston type compressor requiring a power consumption of 22–24% during unloaded operatio, which had been thought to be the minimum value attainable.

Studies on the unloading method in liquid-cooled type rotary compressors have concentrated on control of gas alone. In other words, engineers had restricted their thinking along the lines of this experience with reciprocating piston type compressors and did not for several decades notice that the prime cause of power consumption was the liquid. The method according to the invention can reduce the power consumption during unloaded operation to 18% of full load condition by a liquid control technique which is absolutely different from the conventional gas control technique.

The liquid-cooled type rotary compressor is superior to the reciprocating type compressor because the former has sufficient sealing, cooling and lubricating effects and also a higher rotational speed resulting in a compact light weight design. It also generates less vibration and noise and, consequently, in fewer damaged parts. The liquid-cooled type rotary compressor, however, has not been used widely in place of the reciprocating piston type compressor because the former used to consume three times more power than the latter in unloaded operation. It can be expected that the liquid-cooled type rotary compressor will soon be used widely since the most serious defect of the liquid-cooled type rotary compressor, namely, the high power consumption during unloaded operation, is eliminated by the present invention in which power consumption is lower than that of the reciprocating piston type compressor.

As mentioned above, the present invention can be applied to the compressor at all times, that is, in ordinary compression operation as well as in unloaded operation. The effect of the present invention is, however, particularly great during operation in which the ratio of liquid to gas becomes larger such as in half-unloaded operation, in volume controlled operation where a lesser quantity of gas is fed, and in unloaded operation where no gas but only liquid is fed into the compression chamber. Therefore, we will principally describe the effect of the invention in unloaded operation.

DESCRIPTION OF PREFERRED EMBODIMENTS

Figure 1:
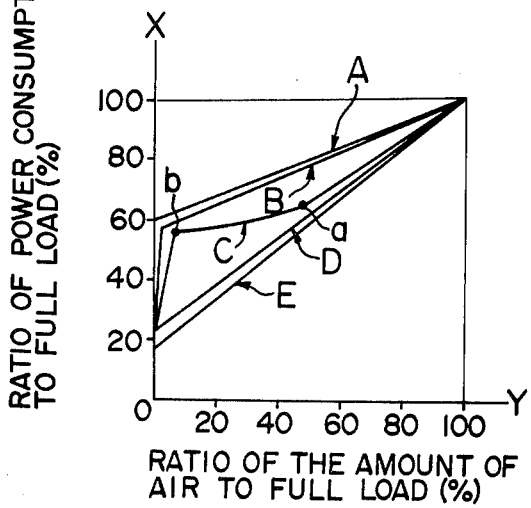
FIG. 1 is a chart showing the power consumption of conventional compressors provided with various present day unloaders and of the compressor according to the present invention.

We will now describe the present invention with reference to the accompanying drawings. FIG. 1 shows the effect on power consumption of various unloaders applied to liquid-cooled type rotary compressor of the type now in general use, wherein the ratio of power consumption to full load is represented on the X axis and the ratio of the amount of air to full load is represented on the Y axis.

Line A in the diagram represents the power consumption of a liquid-cooled type rotary compressor provided with a generally used suction-port closing type unloader. It is seen that even under completely unloaded operation, that is, when no gas is sucked in, this type compressor consumes about 60% of the power consumed under full load.

This power consumption value can of course be reduced by a large margin by using as the power source an engine or a direct current motor whose speed can be regulated to reduce the number of revolutions per minute at the same time when the suction port is closed. However, with the alternating current motor which is widely used in factories and plants, 60% of the power is consumed even during unloaded operation because the motor speed remains constant. Therefore, this type compressor should be employed only for small machines.

Line B in the diagram is the performance curve of an outlet valve release type unloader which release compressed fluid in the delivery lines when completely unloaded by suction-port closing operation. This curve closely follows that for the suction-port closing type unloader mentioned above to just before the completely unloaded operation but then drops to about 22% simultaneously will complete closing. This type unloader, however, loses a large quantity of power during unloaded operation because the greater part of the compressed gas in the delivery line is released into the air. Furthermore the cooling, lubricating and sealing liquid is also lost and contaminates the room. Because of the gas loss and the necessity of replenishing lost gas, this type of unloader is not suitable for the compression of gases other than air.

Line C in the diagram represents the performance curve of an unloader employing a slide valve, a suction-port closing and an outlet release valve according to a patent of S.R.M. Co., Sweden. In this type of unloader, the shut-off position of the inlet of the compression chamber can be changed by a slide valve so as to delay initiation of compression and to change the volume of gas to be compressed for the purpose of power economy. The main object of this type compressor is to vary the volume of gas to be compressed in refrigerating machines. Since the power consumption can be satisfactorily reduced to the point where the ratio of gas is reduced to about 45% as is shown in the diagram, this type of unloader is suitable for refrigerating machine and the like if used within these limits. However, it will be noted from the curve that when the ratio of the volume of gas to full load decreases below about 45%, intake volume control is no longer effective in decreasing power consumption. Therefore, from a point *a* suction-port closing valve is actuated to shut off intake gas, with the result that the curve C gradually approaches the curve A of the suction-port closing type unloader. Accordingly, compressed gas in the delivery line is released into the air at inflection point *b* to reduce power consumption.

As can be seen from the diagram, this type of unloader is not particularly effective in reducing power consumption. Furthermore, it entails a complicated structure including a slide valve, a suction-port closing and a delivery line release valve and is consequently more expensive to manufacture and has greater liklihood of breakdown. In practice, S.R.M. Co. employs this method only on compressors of over 150 KW. For compressors of less than 150 KW, the firm employs simple suction-port closing type unloaders which, as is shown in the curve A are the lowest in efficiency of all types.

Line D in the diagram represents the performance curve of a conventional reciprocating type compressor and is included for reference. In the unloaders for the reciprocating piston type compressor, an intake valve is compulsorily opened to maintain the compression chamber in communication with the air, so that the best efficiency that this type unloader can obtain is approximately 22%.

All the conventional unloaded methods thus deal only with the gas being compressed. Namely, in reciprocating piston type compressors the intake valve is opened to the air and in rotary compressors the suction-port closing method, pressure release method, and slide valve method are used independently or in combination.

Line E in the diagram represents the performance curve during unloaded operation according to the liquid control method of the present invention. As is shown in the curve, the power consumption during unloaded operation can be reduced to 18% with respect to the full loaded operation in the present invention, so that the compressor efficiency according to this invention is even superior to the unload method used in reciprocating piston type compressors. One of the reasons why the present method has such superior efficiency is that it involves no sliding between parts as between the piston and cylinder in the piston type compressors. The efficiency of present method is also superior to that of the pressure release method of rotary compressors shown in the curves B and C in the diagram because in the present invention all the liquid in the delivery chamber is removed to eliminate the harmful influence of the liquid and the pressure in the delivery chamber is reduced to less than atmospheric pressure. Efficiency is further enhanced because the amount of liquid injected into the compression chamber during unloaded operation is throttled to less than half.

The means for controlling the amount of liquid may include a sensor which detects the pressure or the temperature in the compressed gas and liquid tank and actuate an unloading mechanism and a spool valve or the like which is actuated in response to the movement of the unloading mechanism to throttle the passage of the liquid for cooling, lubricating and sealing, so that the amount of liquid injected into the compression chamber can be adjusted in response to unloaded operation. The controlling means, however, is not limited to this type.

The present invention can be applied to liquid-cooled type rotary compressors of the vane type, screw type, worm type (Z type), centrifugal type, turbine type and the like. We will now describe several embodiments of the invention with reference to five widely used types of liquid-cooled rotary compressors.

Differently from conventional unloading systems which attempt to improve operational efficiency by methods dealing with the compressed gas, the principle of the present invention lies in a manner of dealing with the liquid. In the present invention, the gas and liquid are separated from each other immediately after they are delivered from the compression chamber to allow them to act separately for the purpose of power economy.

Although the present invention can be embodied in various specially designed structures, it can be realized merely by adopting a conventional liquid-cooled rotary compressor to meet the following conditions:

1. The gas and liquid should be separated from each other immediately after leaving the compression chamber. To this end, the structure of the delivery chamber should be chosen to facilitate separation.

2. A drainage opening should be formed in the delivery chamber at a position lower than the gas outlet so that liquid is drained from the bottom while gas is removed from the upper part of the chamber.

3. The drainage of liquid should generally be effected by a pump or the like so that the liquid is fed directly to the liquid reservoir of the compressed gas and liquid tank without any intermediate mechanism such as a change-over valve which offers resistance to the liquid and causes unstable conditions. Accordingly, the liquid and the gas are allowed to behave differently immediately after they are delivered from the compression chamber since the liquid is fed directly to the compressed gas and liquid tank or to a liquid separator. The pump may be omitted. In this case, the liquid is forced to flow under the pressure differences between the compressed gas and liquid tank and an injection nozzle. Omission of the pump, however, reduces both the efficiency and stability of the liquid. A changeover valve may be installed if necessary.

4. The drainage operation at the delivery chamber should be continued at all times irrespective of whether the compressor is under loaded operation or under unloaded operation.

5. The amount of the liquid for cooling, lubricating and sealing to be injected into the compression chamber should be automatically controlled in accordance with the volume of compressed gas.

In other words, the present method for reducing the power consumption of a liquid-cooled type rotary compressor by liquid treatment can be realized merely by additionally installing the following means which are mentioned here and will be described hereinafter: a liquid drainage opening 13, a pipe 14, a liquid drainage pump 15 (This pump may be omitted) a pipe 16, and a regulator for controlling the amount of liquid 24.

Figure 2:
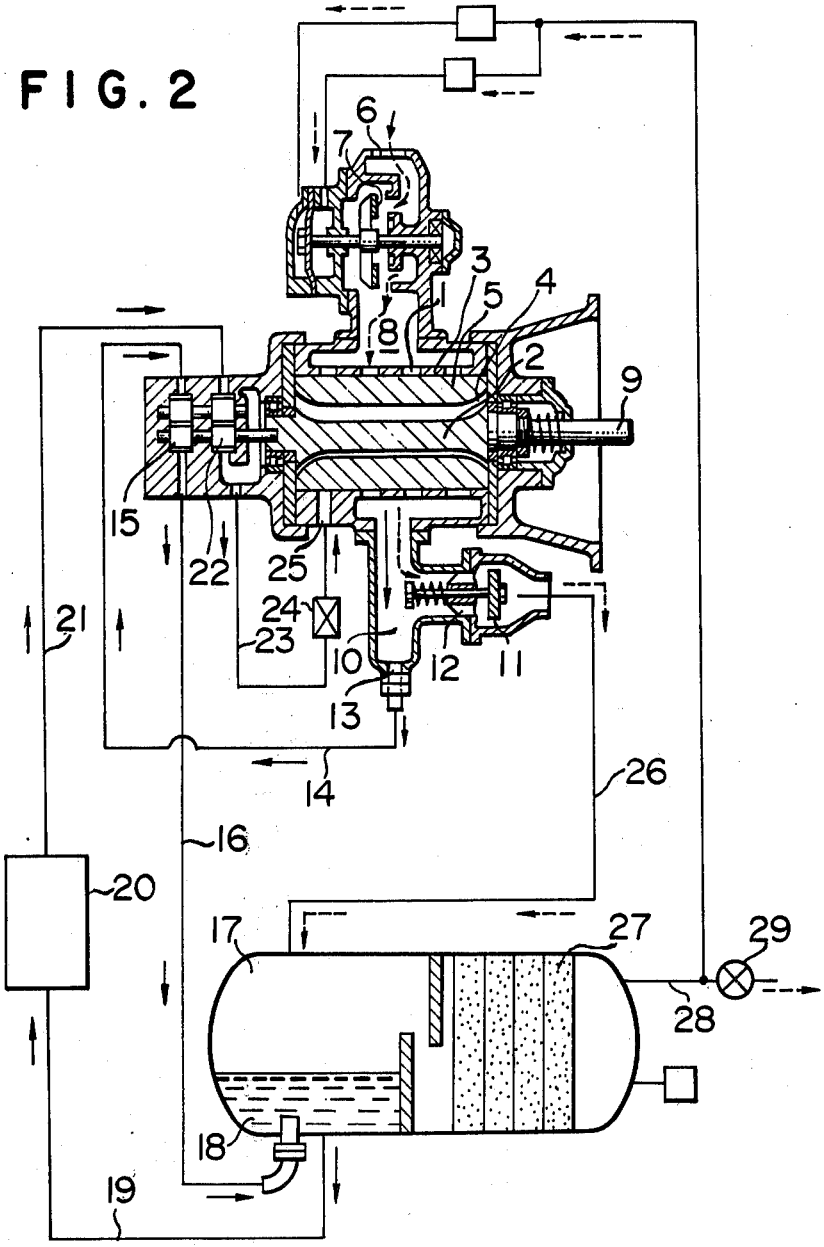
FIG. 2 is a view of an embodiment of the invention when the present invention is applied to a liquid-cooled, vane type rotary compressor.

FIG. 2 shows an embodiment of the present invention as applied to a vane type liquid-cooled rotary compressor, illustrated during ordinary compression operation. For the pupose of clarity, the gas path of the compressor is shown in broken line with arrows while the liquid path is shown in full lines with arrows.

In FIG. 2, a rotor 2 is eccentrically supported within a cylinder 3 and is driven through a rotary shaft 9 by suitable driving means (not shown) connected thereto. The rotor 2 is provided with one or more radial grooves 4 on its periphery. A vane 5 is inserted in each groove 4 so as to project out of the groove 4 and contact with the inner surface of the cylinder 3 for the purpose of forming a compression chamber 1 between the cylinder 3 and the vane 5.

The upper part of the cylinder 3 is connected to an intake opening 6 through an intake chamber 8 and an unloader valve 7. The lower part of the cylinder 3 is communicated with the upper part of the compressed air and liquid tank 17 through a delivery chamber 10, a gas outlet 12, a check valve 11 and a pipe 26. The lower part of the cylinder 3 is also provided with a liquid injection nozzle 25 which is communicated with a liquid reservoir 18 in the compressed air and liquid tank 17 through a regulator 24 for adjusting the amount of liquid, a pipe 23, a liquid injection pump 22, a pipe 21, a cooler 20 and a pipe 19.

Liquid drainage opening 13 formed at the bottom of the delivery chamber 10 is also communicated with the liquid reservoir 18 in the compressed air and liquid tank 17 through a pipe 14, a liquid drainage pump 15 and a pipe 16.

The tank 17 has a separator 27 therein and is also communicated with a valve 29 and with an unloader including the unloader valve 7 through a pipe 28.

Rotation of the rotary shaft 9 causes the rotor 2 to rotate and thereby gradually reduce the volume of the compression chamber 1 and compress gas. Liquid is simultaneously injected or sprayed from the injection nozzle 25 to cool and seal the compressed gas as well as to lubricate the machine. Gas drawn in through the intake opening 6, the unloading valve 7 and the intake chamber 8 is compressed in the compression chamber 1 and is delivered to the delivery chamber 10 in a mixed condition with the liquid injected through the injection nozzle 25. The delivery chamber 10 has a structure suitable for separating the liquid from the gas and in particular, is provided with the liquid drainage opening 13 at a position below the gas outlet 12 containing the check valve 11 therein. The liquid is thus drained from the delivery chamber 10 and fed continuously to the liquid reservoir 18 in the tank 17 through the pipe 14, drainage pump 15 and pipe 16 both in ordinary compression operation and in unloaded operation. The liquid fed into the reservoir 18 in passed through the pipe 19, cooler 20, pipe 21, injection pump 22, pipe 23 and regulator 24 for adjusting the amount of liquid and supplied to the injection nozzle 25 from which it is injected into the compression chamber 1.

If necessary, the injection pump 22 may be omitted. In this case, the liquid is injected by the pressure in the compressed air and liquid tank 17 into the compression chamber 1.

Gas separated from the greater part of the liquid in the delivery chamber 10 is fed into the tank 17 through the gas outlet 12, check valve 11 and pipe 26 and is further separated from finer particles of liquid by the separator 27. The resulting gas is then delivered through the pipe 28 and the valve 29 to the point of use.

When the pressure in the tank 17 rises and reaches a value where further compression is unnecessary or when predetermined temperature is attained, the unloader valve 7 is closed in response to suitable sensing means to restrict the intake of gas and simultaneously the amount of liquid for cooling, lubricating and sealing is adjusted by the regulator 24 for controlling the amount of liquid in accordance with the amount of gas being compressed. During unloaded operation where the unloader valve 7 is completely closed to stop the intake of gas and the check valve 11 is also closed automatically, no gas is introduced into the compression chamber 1 at all and there is no generation of compression heat. Therefore, the compressor requires only the lubricating liquid necessary to lubricate the moving parts, so that the amount of liquid supplied to the compression chamber 1 is regulated by the regulator 24 to less than half of the ordinary amount.

The liquid delivered into the delivery chamber 10 is drained through the drainage opening 13 irrespective of whether the compressor is in compression operation, unloaded operation or half-loaded operation and is fed to the tank 17 or a pressure-resistant liquid separater tank through the pipe 14, drainage pump 15 and pipe 16. Both power consumption and machine damage due to liquid transport can be reduced because of the absence of a change-over valve or any other obstacle which increases flow resistance or causes troubles.

Conventional liquid-cooled type rotary compressors do not have the liquid treating means of the present invention. Thus, the conventional delivery chamber 10 is not provided with the liquid drainage opening 13 or the exclusive liquid flow including the pipe 14, the liquid drainage pump 15 and pipe 16 through which the liquid is fed to the reservoir 18 of the compressed air and liquid tank. As a consequence, the amount of liquid delivered to the delivery chamber 10 is great with respect to the volume of the as delivered during volume controlled operation and unloaded operation. Particularly, during unloaded operation, the delivery chamber 10 and the compression chamber 1 are filled with liquid since only liquid is delivered while the check valve 11 is closed. There thus results the occurance of the oil-lock phenomenum, large loss of power, or stoppage of the machine due to over-load, or vane damage.

As mentioned above, the conventional unloader for the liquid-cooled vane type rotary compressor employs only the principle of suction-port closing type gas control, so that the power consumption of this type machine during unloaded operation is as much as 60% of power consumption under full load condition as is shown by the curve A of the diagram in FIG. 1. The power consumption during unloaded operation, however, can be greatly reduced to less than 20% to that under full load condition merely by adding the simple and safe liquid control mechanism according to the present invention.

Figure 3:
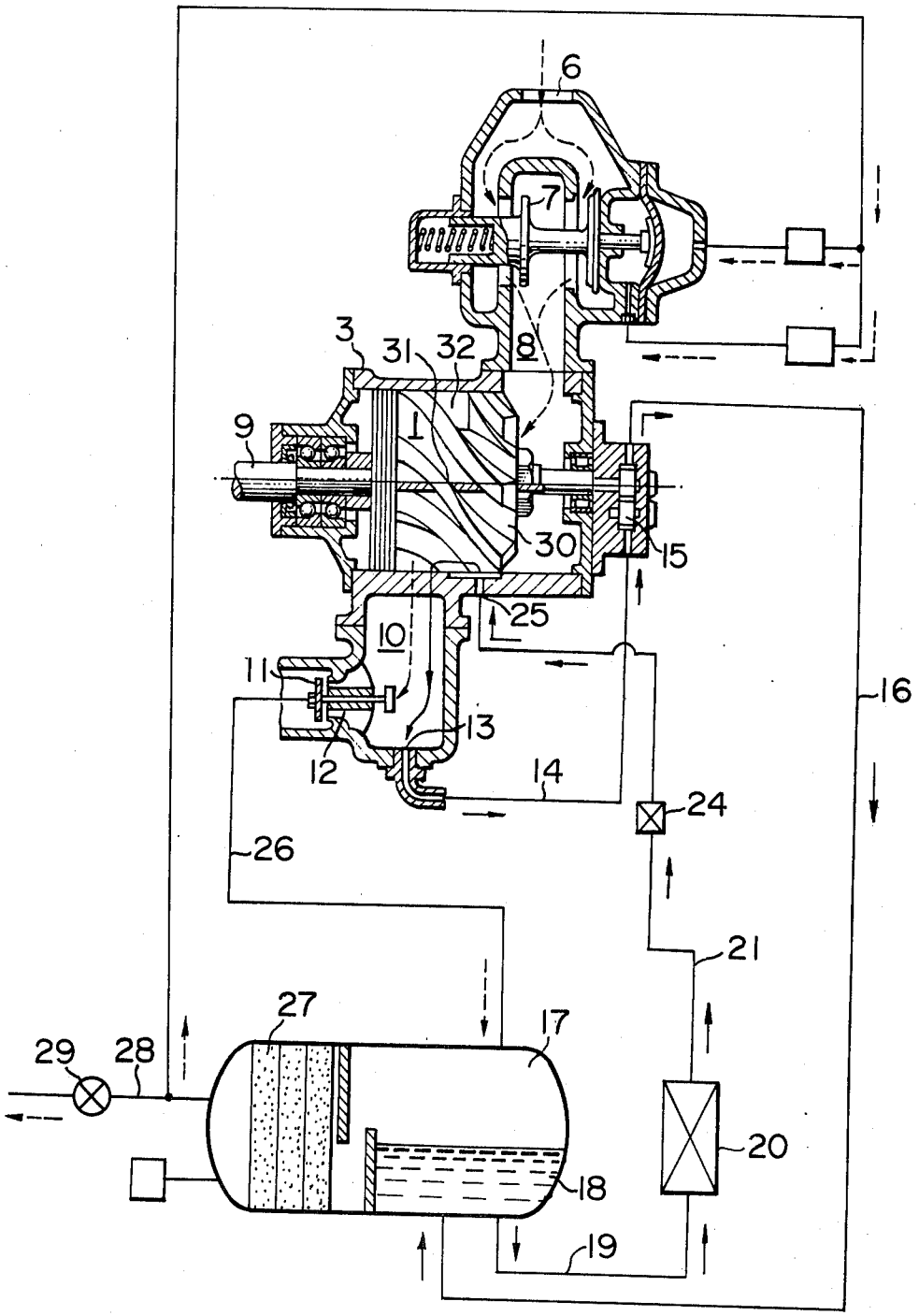
FIG. 3 is a view of the second embodiment of the invention when the present invention is applied to a liquid-cooled, worm type rotary compressor.

FIG. 3 represents another embodiment of the present invention as applied to a worm type liquid-cooled rotary compressor, and in this embodiment, injection pump 22 is omitted only for the purpose of simplification so that liquid is injected into the compression chamber by the pressure of the tank 17 alone. This type of injection is employed mainly in compressors of small capacity since the amount of liquid injected varies in accordance with variation in the pressure in the tank 17. The drawing illustrates the compressor during ordinary compression operation where the unloader valve 7 is opened.

In this worm type liquid-cooled rotary compressor (known as the single screw type or the Z-type compressor), a worm wheel 31 meshes at right angles with a worm 30 so that compression chambers are formed between the cylinder 3, the worm wheel 31 and grooves 32 of the worm. The volume of compression chamber 1 is reduced gradually to compress gas when the worm 30 is resolved. Other structural components are the same as in FIG. 2.

Gas is sucked in from an intake opening 6 and enters the compression chamber 1 formed by the grooves 32 of the worm 30 through an unloader valve 7 and an intake chamber 8. The gas is then confined in the compression chambers 1 by the worm wheel 31 and compressed when the volume of the compression chambers 1 is reduced by revolving the worm 30 through a rotary shaft 9. The resulting compressed gas is delivered to a delivery chamber 10. During this compression operation, liquid for cooling, lubricating and sealing is injected by an injection nozzle 25 into the compression chambers 1 and mixed with the gas. The mixture of gas and liquid is then delivered to the delivery chamber 10 and the liquid is immediately separated from the gas. The separated liquid is drained from a liquid drainage opening 13 formed below a gas outlet 12 and fed to the tank 17 through pipe 14, liquid drainage pump 15, and pipe 16. The liquid stored in a liquid reservoir 18 is forced by the pressure in the tank 17 to flow through pipe 19, a cooler 20, pipe 21, and a regulator 24 for controlling the amount of liquid and is then injected into the compression chambers 1 by the injection nozzle 25. The resulting gas separated from liquid in the delivery chamber 10 is fed to the tank 17 through the gas outlet 12, the check valve 11, and pipe 26 and then supplied to the point of use through a pipe 28 and a valve 29 after finer liquid particles are separated by passing the gas through a separator 27.

In conventional worm type liquid-cooled rotary compressors, the delivery chamber 10 is provided with only the gas outlet 12 as in the case of vane type rotary compressors. Therefore, both liquid and gas are discharged through this gas outlet during ordinary compression operation. Full amount of liquid is delivered into the compression chambers 1 and the delivery chamber 10 even when the amount of gas is decreased by partly closing the intake choke valve 7 or when the gas supply is completely stopped during volume controlled operation, so that the ratio of liquid to gas increases thus reducing the gas cushioning effect, and causing oil locking damage and breakdown of the machine and larger power consumption.

This worm type liquid-cooled rotary compressor requires about twice the liquid of other liquid-cooled rotary compressors since high mechanical preciseness is hardly obtainable for the worm type, so that the power consumption during unloaded operation is as high as 70% of full loaded operation. This value of power consumption can be reduced to less than 20% of full loaded operation by employing the present invention. Furthermore, worm wheel 31 which is usually made of plastic material, can be prevented from damage by oil locking.

Figure 4:
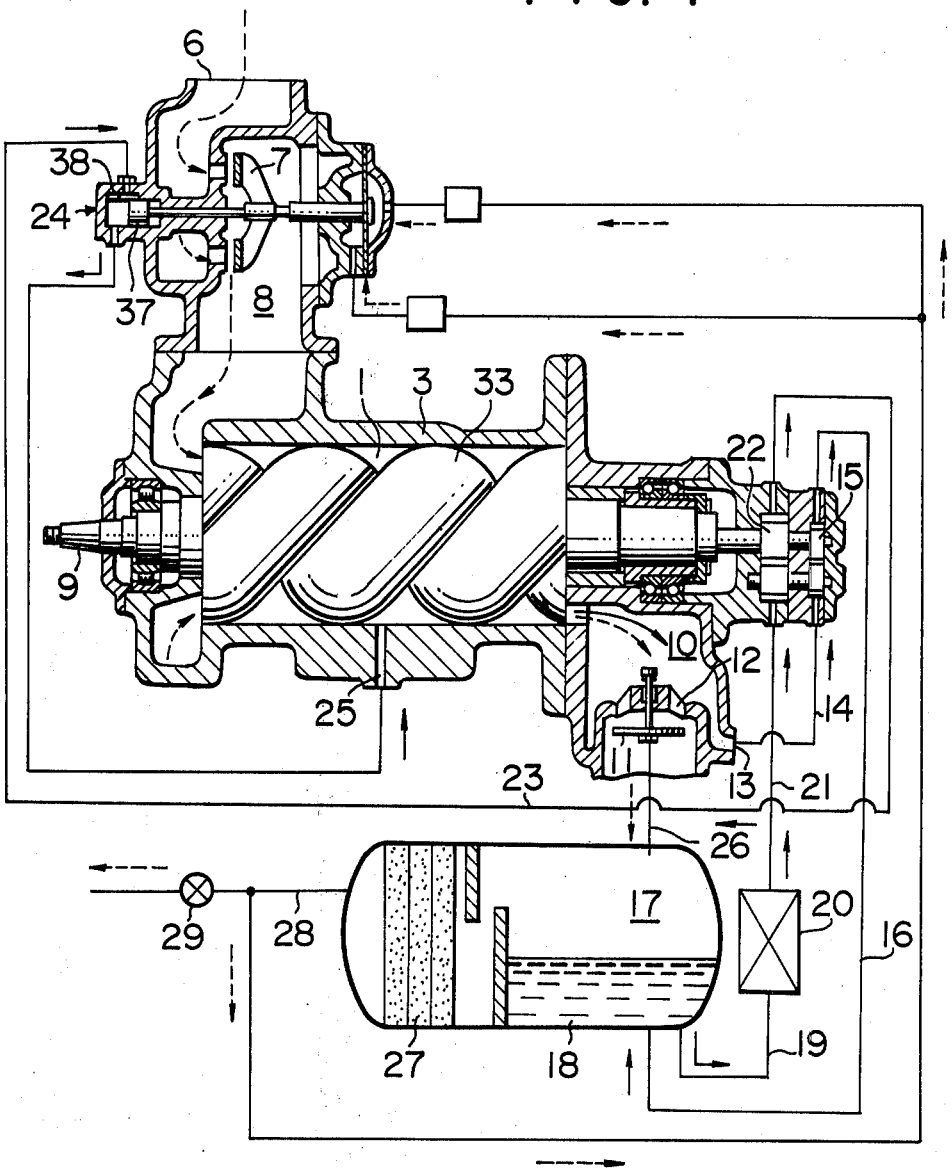
FIG. 4 is a view of the third embodiment of the invention when the present invention is applied to a liquid-cooled, screw type rotary compressor.

FIG. 4 represents a third embodiment of the present invention as applied to a screw type liquid-cooled rotary compressor. This screw type liquid-cooled rotary compressor has the most theoretically ideal structure and has superior durability is comparison with other vane type or worm type rotary compressors. Particularly, rotary contact parts of screw type compressors are made of metal having superior strength, while those of the vane type or worm type compressor are made of plastic having less strength, and the screw consists of two parallel shafts, so that the life of this screw type rotary compressor is virtually endless. The screw type rotary compressor however, is defective in that it consumes more power than other rotary compressors during unloaded operation. The unloading method proposed by S.R.M. Co. to eliminate this defect has a very complicated structure causing higher cost, higher susceptibility to breakdown and lower efficiency. Furthermore, the conventional compressor has anothe defect in that the air in the room is polluted when the compressed gas, mixed with the liquid, is discharged out of the delivery line. This further results in a loss of the liquid and a loss of power since compressed gas is released into the air. For these reasons, screw type rotary compressor has not yet been able to replace the reciprocating piston type compressors.

FIG. 4 shows an embodiment of the present invention as applied to a liquid-cooled one stage compression screw type rotary compressor, illustrating the compressor under full loaded operation.

Gas is sucked in from an intake opening 6 and fed to the compression chambers 1 through an unloader valve 7 and an intake chamber 8. The compression chambers 1 are formed by two screw type rotors 33 being meshed with each other. When one of the rotors 33 is revolved by a rotary shaft 9, the other rotor meshing with the former (not shown) is also revolved. The volume of compression chambers 1 defined between the contact lines of the two rotors 33 and the inner surface of the cylinder 3 are reduced to compress gas when the rotors 33 are revolved. The resulting compressed gas is delivered into a delivery chamber 10. Other structured elements are the same as those in FIG. 2. Liquid for cooling, lubricating, and sealing is injected into the compression chambers 1 by an injection nozzle 25, and the mixture of gas and liquid is delivered into the delivery chamber 10. The delivery chamber 10 has a structure and dimensions suitable for separating liquid from gas. Thus, liquid drainage opening 13 is formed below the gas outlet 12, so that liquid being delivered into the delivery chamber 10 is continuously drained through the drainage opening 13 irrespective of whether the compressor is in ordinary compression operation or unloaded operation, and is returned to the tank 17 or liquid reservoir 18 through a pipe 14, a drainage pump 15, and a pipe 16. The liquid in the liquid reservoir 18 is then pumped by the injection pump 22 through a pipe 19, a cooler 20 and a pipe 21 and injected into the compression chambers 1 by an injection nozzle 25 through a pipe 23 and a regulator 24 for controlling the amount of liquid.

The regulator 24 for controlling the amount of liquid is actuated in response to the amount of intake gas, the gas pressure, the gas flow rate or the operating temperature and therefore various types of regulators may be used. In the drawing, as an example, a regulator that can control the amount of liquid in response to the regulation of intake gas by an unloader valve 7 is illustrated.

As is shown in cross section in FIG. 4, the regulator 24 for controlling the amount of liquid includes a cylinder receiving a piston 37 therein and having two ports, inlet and outlet, which are connected to pipe 23. As the piston 37 slides in the cylinder, the opening area of a longitudinal groove 38 is varied to adjust the amount of liquid passing through the regulator 24. The piston 37 is linked with the unloader valve 7 so that the piston 37 is moved right and left when the unloader valve 7 is moved right and left. Thus, the amount of liquid to be fed to the injection nozzle 25 through the pipe 23 and injected into the compression chambers 1 can be controlled by the movement of the piston 37 in accordance with the volume of intake gas.

The regulator for controlling the amount of liquid 24 mentioned-above may of course be applied to the other types of liquid-cooled rotary compressors having the unloader valve 7, namely, the liquid-cooled vane type rotary compressor, liquid-cooled worm type rotary compressor, liquid-cooled centrifugal type rotary compressor, liquid-cooled turbine type rotary compressor or the like.

The resulting gas separated from the greater part of the liquid in the delivery chamber 10 is fed from the gas outlet 12 through check valve 11 and pipe 26 to the tank 17 and then supplied to the point of use through a pipe 28 and a valve 29 after finer liquid particles are removed by a separator 27.

In the conventional liquid-cooled screw type rotary compressor, unloaded operation is performed in practice by merely choking the intake gas flow or by the combination of slide valve, suction-port closing and pressure gas releasing operations as is the case in the system used by S.R.M. Co. These methods, however, all depend on gas control alone.

On the contrary, the present invention relates to liquid control at the side of the delivery line and is totally different from the conventional gas control technique and greatly improves power economy.

As mentioned above, when the unloader valve 7 is closed, the amount of liquid injected for cooling, lubricating and sealing will be reduced to less than half the amount during full-load operation and furthermore the liquid is drained continuously through the liquid drainage opening 13 formed below the gas outlet 12. Therefore, there is no possibility of liquid being accumulated in the delivery chamber 10 or in the compression chambers 1, so that oil locking will not occur. As even the small quantity of compressed gas remaining in the delivery chamber is removed with the liquid, more economy is attained than in compressors which release compressed air in the delivery line into the atmosphere.

Figure 5:
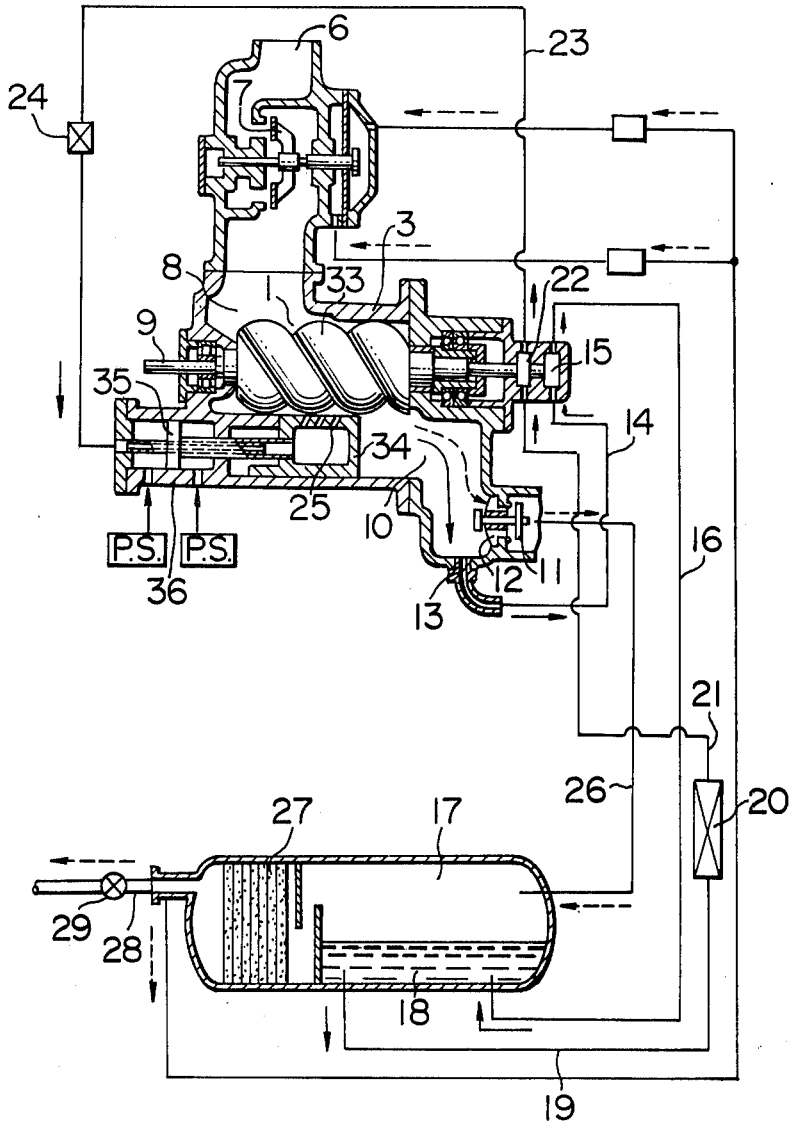
FIG. 5 is a view of the fourth embodiment of the invention when the present invention is applied to a liquid-cooled, screw type rotary compressor provided with a slide valve.

FIG. 5 represents a fourth embodiment of the present invention as applied to a liquid-cooled screw type rotary compressor provided with a slide valve.

In conventional screw type liquid-cooled rotary compressors, a slide valve is moved axially to change the intake shut-off position for the purpose of changing the volume of gas which is sucked compressed. In this type compressor, as is shown by the curve C of the diagram in FIG. 1, the power consumption can be reduced satisfactorily in accordance with the decrease in intake gas until the volume of intake gas reaches about 45% of full intake. In the range below 45%, the intake volume control, however, cannot be effected by mere control of the slide valve, so that it becomes necessary to control intake gas by actuating the unloader valve. Accordingly, the power consumption increases again as a result of the decrease in intake volume and finally when the intake volume reaches to zero, the power consumption increases to about 60% of full loaded operation as in the liquid-cooled screw type rotary compressor fitted with suction-port closing type unloader. Therefore, the pressure in the delivery line must be released into the air in order to reduce power consumption when the intake volume reaches zero.

Thus, in the above-mentioned method the unloading operation is performed only by gas control technique and a great amount of power is lost during unloaded operation, because the compressed gas, which has been compressed using the power, is released into the air. In this method moreover, liquid for cooling, lubricating and sealing is also lost along with the gas release, and contaminates the air in the room. Noise is also generated when the compressed gas is released into the air, and if the gas is inflammable, no release into the air is permissible. Thus, this type compressor cannot reduce power consumption either so that it has not been able to replace the conventional reciprocating piston type compressor.

If the liquid control technique according to the present invention is applied to the liquid-cooled screw type rotary compressor having a slide valve, it can be used safely with any gas, the power consumption can be reduced continuously in accordance with the decrease in intake gas and the power consumption during unloaded operation can be reduced to 18% of full loaded operation.

The drawing of FIG. 5 represents an embodiment of the present invention when the invention is applied to a liquid-cooled screw type compressor having a slide valve, and shows the compressor during full loaded operation. Gas is sucked in from the intake opening 6 and fed to the compression chambers 1 through the unloader valve 7 and intake chamber 8. In the compression chambers 1, there are provided two screw type rotors 33 meshed with each other and when one of the rotors 33 is revolved by the rotary shaft 9, the other rotor (at the rear side of the rotor 33 and not shown) meshing with the former is also revolved. The volume of compression chambers 1 formed between the cylinder 3 and the contact lines of the two rotors 33 are reduced to compress gas therein when the rotors 33 are revolved. The resulting compressed gas is delivered to the delivery chamber 10. Structures other than those already described are the same as those shown in FIG. 2. Liquid for cooling, lubricating and sealing is injected from the injection nozzle 25 and the resulting mixture of gas and liquid is delivered to the delivery chamber 10. The delivery chamber 10 has a structure and dimensions suitable for separation of liquid from gas, and the liquid drainage opening 13 is positioned below the gas outlet 12. A slide valve 34 is provided below the rotors 33. Liquid is drained continuously through the liquid drainage opening 13 irrespective of whether the compressor is in full loaded operation, or when the volume of compressed air is decreased by shifting the slide valve 34 to right in FIG. 5 to restrict intake volume, or in unloaded operation where the unloader valve 7 is closed. The resulting liquid is then returned to the liquid reservoir 18 in the tank 17 through pipe 14, liquid drainage pump 15 and pipe 16 and thereafter is fed through pipe 19, cooler 20, pipe 21, liquid injection pump 22, pipe 23, regulator 24 for controlling the amount of liquid, and further through a piston 35 attached to the slide valve 34 and inner passage of the slide valve 34 to liquid injection nozzle 25, through which the liquid is injected in to the compression chambers 1. The piston 35 is actuated right and left under pressure from a pneumatic or hydraulic pressure source P.S.

It is also possible to connect the regulator 24 to the slide valve 34 directly as is shown in FIG. 4 so that the regulator 24 is controlled in response to intake gas volume.

Gas separated from the greater part of the liquid in the delivery chamber 10 is fed to the tank 17 through the check valve 11 and pipe 26 from the gas outlet 12 and then supplied to the point of usage through pipe 28 and a valve 29 after being passed through a separator 27 to remove finer liquid particles.

When demand for compressed gas decreases, and accordingly the pressure in the compressed air and liquid tank 17 rises, or when it reaches a predetermined temperature, pneumatic or hydraulic pressure is supplied from the pressure source P.S. to the cylinder 36 to move the piston 35 and, consequently the slide valve 34 to the right. Accordingly the intake shutoff position is changed so that the volume of the compression chambers is reduced to restrict the volume of intake gas. Simultaneously, the regulator 24 for controlling the amount of liquid is also actuated to reduce the amount of liquid injected into the compression chambers in response to the decrease in intake gas. When the amount of compressed gas used is further decreased, or when the pressure in the tank 17 rises further, or when the gas in tank 17 reaches a desired temperature, the compressor is no longer required to continue compression operation. Therefore, when these conditions are detected, the unloader valve 7 is closed to stop the gas supply completely, the check valve 11 is also closed, and the regulator 24 for controlling the amount of liquid to be injected is further advanced to reduce the amount of liquid to such amount as is necessary for lubrication of the machine only.

Thus, liquid delivered to the delivery chamber 10 is drained continuously through the liquid drainage opening 13 positioned below the gas outlet 12 even during intake gas controlled operation and during unloaded operation so that there is no accumulation of liquid in the delivery chamber 10 or in the final compression chambers 1 and no possibility of liquid lock trouble. Since compressed gas which remains in the delivery chamber 10 is also drained with liquid during unloaded operation to reduce the pressure below atmospheric pressure, the present invention is superior in view of power saving to the conventional method which releases the pressure in the delivery line to the air.

The power consumption during unloaded operation can be greatly reduced when the present liquid control technique is applied to liquid-cooled type rotary compressors.

To simplify the mechanism, the liquid drainage pump 15 may be omitted although some loss of efficiency and stability will result. We will now describe a fifth embodiment where the present invention is applied to a liquid cooled type rotary compressor having no pumps.

Figure 6:
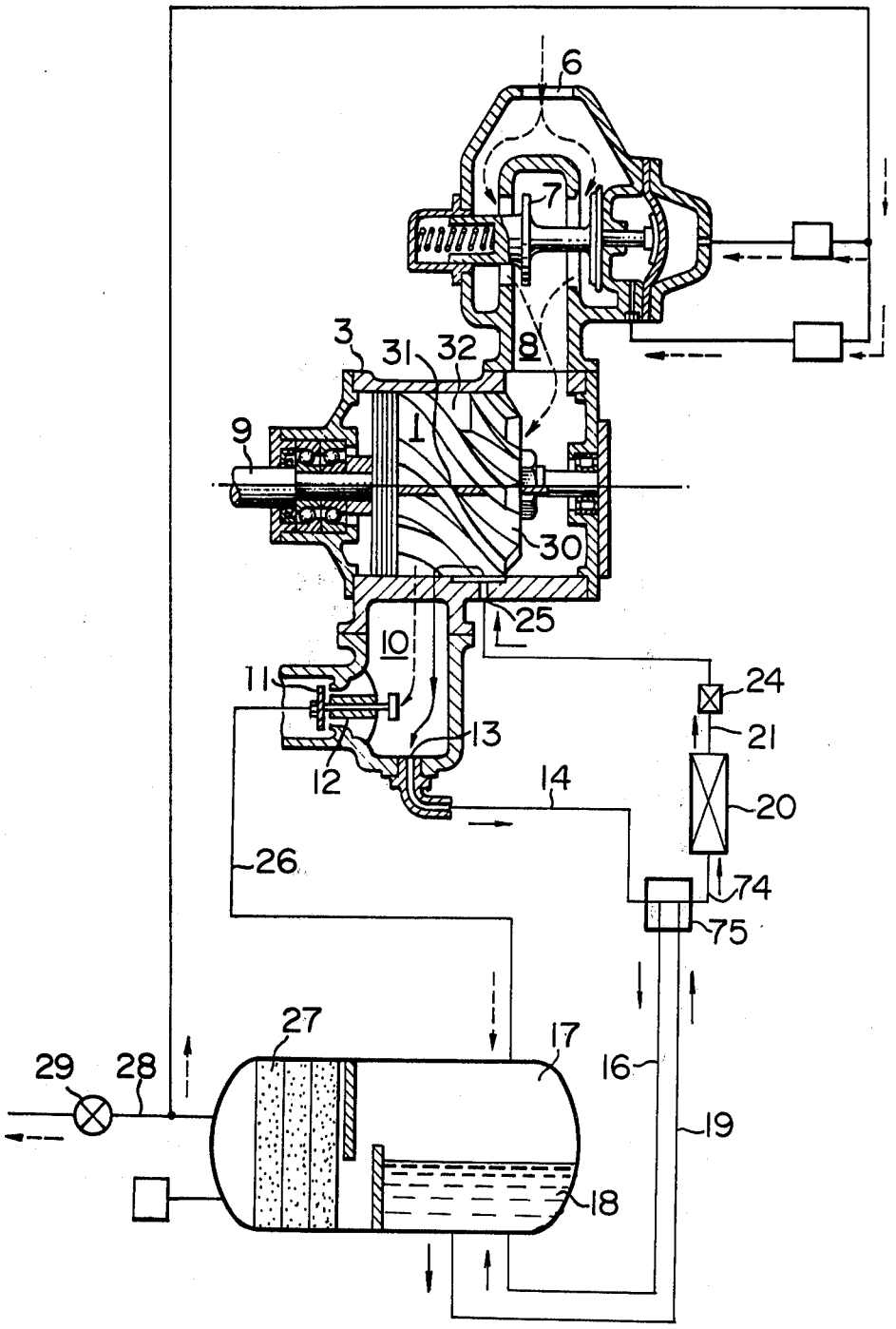
FIG. 6 is a view of the fifth embodiment of the invention when the present invention is applied to a liquid-cooled rotary compressor having no pump.

Though the present invention without pumps is described as applied to the worm type liquid-cooled rotary compressor as in FIG. 6 by way of example, it may be easily understood that it can also be applied to the vane type, screw type, eccentric type or centrifugal type liquid-cooled rotary compressors.

FIG. 6 illustrates the compressor in the state of ordinary compression operation. Detailed functions of this worm type liquid-cooled rotary compressor are the same as those explained in respect of FIG. 3 and therefore are deleted here.

Gas being sucked in from the intake opening 6 is compressed in the comparison chambers 1, and liquid injected from the injection nozzle 25 is delivered with the gas into the delivery chamber 10 where a great part of the liquid is separated from the gas. The resulting gas is fed to the tank 17 through the check valve 11, gas outlet 12 and pipe 26, while the resulting liquid which is separated from the gas in the delivery chamber 10 is drained from the liquid drainage opening 13 positioned below the gas outlet 12 and fed to the liquid reservoir 18 through pipe 14 and pipe 16. The liquid in the liquid reservoir 18 is then fed to the cooler 20 through pipe 19, pipe 74 to be cooled, and passed through pipe 21, the regulator 24 for controlling the amount of liquid to the injection nozzle 25 through which the liquid is injected into the compression chambers 1. The liquid is then delivered to the delivery chamber 10 together with compressed gas so as to complete a full cycle. The circulation of liquid is effected by the pressure difference between the compressed air, in the tank 17 and the injection nozzle 25.

During unloaded operation where the unloader valve 7 is closed and gas is not delivered into the delivery chamber 10 but only liquid is delivered into the chamber 10 and where the check valve 11 is also closed, it is necessary to prevent accumulation of liquid in the delivery chamber 10 and compression chambers 1 so as to prevent the liquid lock phenomenum. To this end, the circulation of liquid must be controlled either by circulating the liquid through the same path as during ordinary compression operation, or by adding a change over valve 75 to the path including pipes 14, 16 and pipes 19, 74, so that the path including pipes 16, 19 is shut off while the path including pipes 14, 74 is opened under unloaded operation to circulate liquid through the delivery chamber 10, liquid drainage opening 13, pipe 14, change over valve 75, pipe 74, cooler 20, pipe 21, the regulator 24 for controlling the amount of liquid, injection nozzle 25, compression chambers 1 and the delivery chamber 10 successively cooling the liquid.

This circulation is performed by the pressure difference between the delivery chamber 10 and the injection nozzle 25. The regulation of the amount of liquid to be circulated may be effected by the change over valve 75, if necessary.

Thus, by this arrangement, accumulation of liquid in the delivery chamber 10 and in the compression chambers 1 can be effectively prevented, the amount of liquid can also be controlled, and liquid is circulated under a cooled condition. The liquid lock phenomenon and loss of power can thus be prevented and effective lubrication and cooling can be attained to protect the compressor from damage.

The present invention has herein been described in five embodiments as applied to the liquid-cooled vane type rotary compressor, the liquid-cooled worm type rotary compressor, the liquid-cooled screw type rotary compressor, the liquid-cooled screw type rotary compressor having a slide valve, and the liquid cooled worm type rotary compressor having no pump. In any of these compressors, the present invention can be realized by changing the shape of the conventional delivery chamber 10 so as to facilitate separation between gas and liquid, by providing the liquid drainage opening 13 at a position below the gas outlet 12, by connecting a liquid drainage pump 15 (this pump may be omitted) so as to feed liquid continuously to the tank 17 or to a pressure resistant liquid separater or by providing a mchanism to circulate liquid directly to the cooler without passing the tank 17, and by installing the regulator for controlling the amount of liquid in the path to the liquid injection nozzle. It is apparent that the present invention is superior in efficiency and mechanical structure to the conventional technique for reducing power consumption.

To clarify the fundamental differences between the present invention and prior art in theory and structure, we now compare the present invention with an invention described in Japanese patent application publication No. 16664 of 1967 (corresponding to U.S. Pat. No. 3,260,444). The device of the prior art is depicted in FIG. 7 to FIG. 11 wherein the reference numbers have been changed from those used in the Japanese Patent Application Publication.

Figure 7:
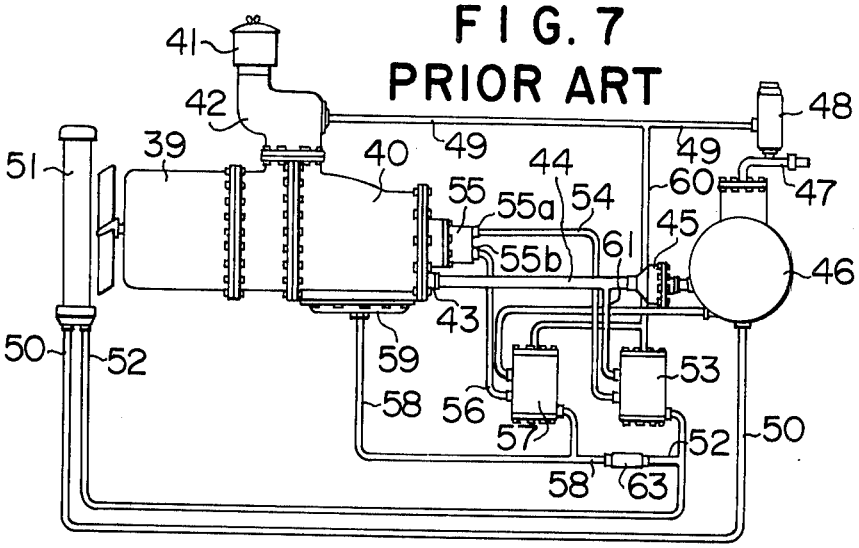
FIG. 7 PRIOR ART
FIG. 7 is a schematic view showing the general structure of an oil-cooled rotary compressor provided with an unloader of prior art.
Figure 8:
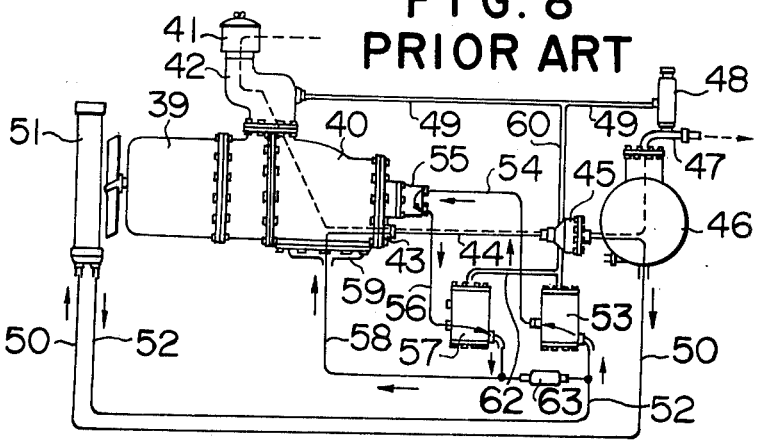
FIG. 8 PRIOR ART
FIGS. 8 and 9 are views showing fluid flow passages of the rotary compressor of FIG. 7 during compression operation and unloaded operation respectively.
Figure 9:
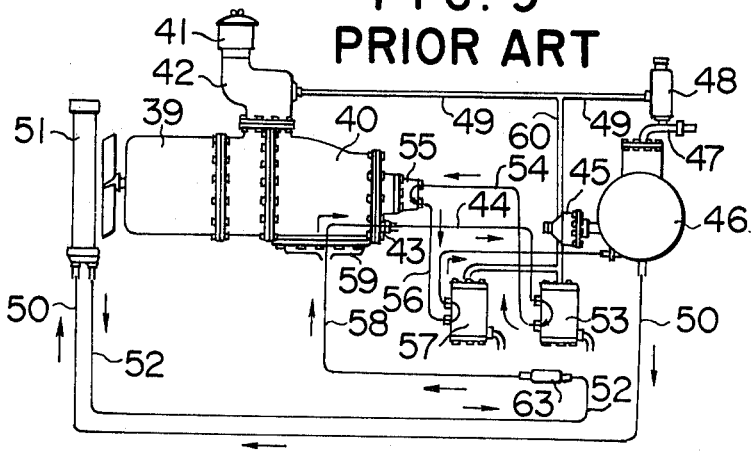
FIG. 9 PRIOR ART

FIG. 7 shows an overall schematic view of the invention described in Japanese patent publication No. 16664 of 1967, while FIGS. 8 and 9 are explanatory views of fluid flow passages of the invention, wherein FIG. 8 shows the compressor in compression operation and FIG. 9 shows it in unloaded operation. Broken lines with arrows illustrate passages of gas while full lines with arrows illustrate passage of liquid.

At first, compression operation is described with respect to FIG. 7 and FIG. 8. Liquid-cooled type rotary compressor 40 driven by a motor 39 sucks in gas through an intake filter member 41 and an inlet valve assembly 42 and compresses the gas therein. The resulting compressed gas is delivered with liquid for cooling, lubricating and sealing (in this case oil is used) through a delivery outlet 43, a delivery pipe 44 and a check valve 45 to a tank 46. The oil is separated from gas therein and gathered at the bottom thereof, while the resulting gas is supplied to the point of use through pipe 47. In comparison with FIG. 4 according to the present invention, the compressor of FIG. 8 has no delivery chamber for separating liquid from gas, so that the mixture of gas and liquid is directly fed through the delivery pipe 44 and check valve 45 from the delivery outlet 43 to the tank 46. On the contrary, in the present invention as is shown in FIG. 4, liquid is separated from gas immediately after they leave the compression chambers 1 and the resulting compressed gas is fed to the tank 17 through the check valve 11 while liquid free from gas is pumped from the liquid drainage opening 13 through liquid pump 15 to the tank 17. This comes from the theory of the present invention that different materials having different characteristics should be separated from each other immediately after they have fulfilled their purposes. In FIGS. 7 and 8 which illustrate an embodiment of the invention described in Japanese patent publication No. 16664 of 1967, the mixture of gas and liquid is directly fed to the tank 52 in the same manner as in the conventional technique. Even in this point, the present invention differs from this prior invention.

Figure 10:
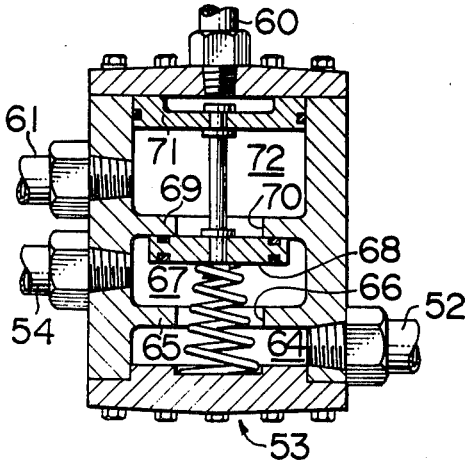
FIG. 10 PRIOR ART
FIG. 10 is a cross section of a change-over valve used in the rotary compressor of FIG. 7.

Secondly, in the present invention as is shown in FIG. 4, liquid collected at the bottom of the tank 17 is fed through pipe 19, cooler 20, pipe 21, injection pump 22, pipe 23 and regulator 24 for controlling the amount of liquid to the injection nozzle 25 through which the liquid is injected into the compression chamber 1 as is shown in solid lines. On the contrary, the invention described in Japanese patent publication No. 16664 of 1967 has a system wherein liquid is fed through the tank 46, pipe 50, oil cooler 51, pipe 52, change over valve 53, pipe 54, oil pump 55, pipe 56, change over valve 57, and pipe 58 and through an oil chamber formed in a lid 59 of the compressor to the compression chambers and to bearings. Making a comparison between FIG. 8 and FIG. 4 according to this invention, it will be apparent that the invention described in Japanese Patent publication No. 16664 of 1967 requires two additional change over valves 53, 57 having very complicated structures as shown in FIG. 10. This means that the prior invention has not taken into account such means as are considered in the present invention in view of the theory of hydrodynamics. For example, passages for higher viscosity fluid should be simplified as much as possible to prevent gas lock, flow resistance of liquid should be reduced and the structure should be designed to be trouble free.

Figure 11:
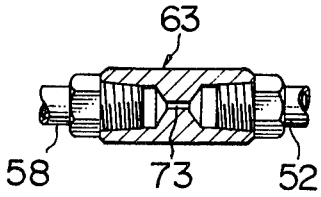
FIG. 11 PRIOR ART
FIG. 11 is a cross section of an orifice also used in the rotary compressor of FIG. 7.

Furthermore, the orifice 63 shown in FIG. 11 causes loss of power since this orifice communicates the intake side of pipe 52 with the delivery side of pipe 58 as shown in FIG. 8, so that liquid flows backwards from higher pressure pipe 58 to lower pressure pipe 52. The above-mentioned differences between the present invention and the invention described in Japanese patent publication No. 16664 of 1967 are those relating to ordinary compression operation.

When the compressor is brought into unloaded operation, no gas flow occurs but only liquid is circulated. Under this condition, the invention according to Japanese patent publication No. 16664 of 1967 forms a flow passage as shown in FIG. 9, while the present invention forms a flow passage as shown in the solid lines of FIG. 4. Thus, in the present invention, liquid flows through the very same path as in ordinary compression operation as shown in FIG. 4 and the regulator 24 for controlling the amount of liquid reduces the amount of circulating liquid to a suitable value in accordance with the volume of gas being compressed. This regulator 24 responds faithfully to the unloader valve 7 and has a simple structure. On the contrary, the invention described in Japanese patent publication No. 16664 of 1967 has a system where liquid must pass through two change over valves 53, 57 again. What is more, oil supply to the compressor is restricted by a small hole 73 of the orifice 63. The quantity, however, cannot be changed. Therefore, if this small hole 73 is choked up with dust, oil cannot be supplied to the compressor 40 resulting in seizure or other troubles.

Such a complicated structure should not be installed in a flow path requiring low flow resistance. From this point alone, it can be understood that the theory of the present invention differs from known techniques.

It will be apparent from the descriptions hereinbefore that the present invention is based on the principle theory that liquid and gas which have different characteristics should be separated from each other as soon as the liquid has fulfilled its cooling, lubricating and sealing functions and that the gas and liquid should be handled in different ways through independent circuits having as small resistance as possible. Thus, liquid and gas are dealt with separately immediately after they leave the compression chambers. Such separate handling is performed continuously irrespective of whether the compressor is in loaded operation or unloaded operation.

Furthermore, the liquid control technique can be accomplished by a simple structure including a liquid drainage pump 15 (which may be omitted), and pipes 14 and 16 connecting the delivery chamber 10 to the compressed gas and liquid tank 17, so that no valve or its mechanism are required in the lines, resulting in trouble free operation. It will be apparent that the liquid drainage pump 15 is working when the compressor is in operation and therefore requires no starting and stopping mechanism, so that it has a simple structure, reduced flow resistance and superior efficiency.

Furthermore, power consumption can be reduced by using the regulator 24 for controlling the amount of liquid as is shown in FIG. 4 so as to inject a suitable amount of liquid for cooling, lubricating and sealing continuously in accordance with the amount of compressed gas.

It is apparent from the description hereinbefore that the present invention provides a novel method for reducing the power consumption of the liquid-cooled type rotary compressor by a liquid control technique.

What is claimed is:

1. In the method of operating a liquid-cooled type rotary compressor of the type which includes a cylinder having an inlet opening and an outlet opening, rotary means provided in said cylinder, at least one compression chamber defined between said rotary means and said cylinder, an unloader connected to said cylinder to communicate with said inlet opening, said cylinder also having a delivery chamber in a lower part of the cylinder, said delivery chamber having an upper opening, gas outlet and a liquid drainage opening, said upper opening communicating to said outlet opening, a reservoir having a gas space for compressed gas and a liquid space for liquid for cooling, lubricating and sealing, first conduit means connecting the lower part of said cylinder and said reservoir to communicate with said gas outlet and the gas space in said reservoir, second conduit means connecting said reservoir and the lower part of said cylinder to communicate with said liquid drainage opening and said liquid space in said reservoir, a liquid drainage pump provided in said second conduit means, third conduit means connecting said cylinder and said reservoir to communicate with said at least one compression chamber and said liquid space in said reservoir, and a regulator provided in said third conduit means for adjusting the amount of liquid to be injected into said at least one compression chamber, the improvement characterized by the steps of delivering from said compression chamber into said delivery chamber a mixture of said compressed gas and liquid, separating the gas and liquid components of said mixture immediately after the mixture is delivered into said delivery chamber, the liquid taking its own way in said second conduit means separately from the gas in said first conduit means, and pumping said liquid from said delivery chamber into said reservoir whereby the pressure in the delivery chamber can be decreased to reduce back pressure in the compressor and thereby reduce the power consumed by the compressor.

2. The improvement as claimed in claim 1 wherein the amount of the liquid injected into said at least one compression chamber is regulated during the gas volume controlled operation and unloaded operation, so that the ideal ratio between volume of gas and amount of liquid is given always when the compressor is in operation.

3. The improvement as claimed in claim 1 wherein said delivery chamber has a structure and dimension suitable for separate-liquid and gas, and said liquid drainage opening is positioned below said gas outlet in said delivery chamber to separate the liquid and gas by gravity action.

* * * * *